US008951053B2

(12) United States Patent
Ho

(10) Patent No.: US 8,951,053 B2
(45) Date of Patent: Feb. 10, 2015

(54) RECEPTACLE CONNECTOR AND CONNECTOR ASSEMBLY

(71) Applicant: Molex Incorporated, Lisle, IL (US)

(72) Inventor: Yi-Tse Ho, Taipei (TW)

(73) Assignee: Molex Incorporated, Lisle, IL (US)

( * ) Notice: Subject to any disclaimer, the term of this patent is extended or adjusted under 35 U.S.C. 154(b) by 63 days.

(21) Appl. No.: 13/905,492

(22) Filed: May 30, 2013

(65) Prior Publication Data

US 2014/0154913 A1 Jun. 5, 2014

(30) Foreign Application Priority Data

May 31, 2012 (TW) ..... 101119527 A

(51) Int. Cl.

| | |
|---|---|
| ***H01R 13/62*** | (2006.01) |
| ***H01R 13/703*** | (2006.01) |
| ***H01R 27/00*** | (2006.01) |
| *H01R 12/72* | (2011.01) |
| *H01R 13/645* | (2006.01) |

(52) U.S. Cl.

CPC ..... *H01R 13/703* (2013.01); *H01R 27/00* (2013.01); *H01R 12/722* (2013.01); *H01R 13/6456* (2013.01)

USPC ..... 439/159

(58) Field of Classification Search

CPC ..... H01R 13/635; H01R 13/62938

USPC ..... 439/159, 541.5, 630, 157, 154, 155

See application file for complete search history.

(56) References Cited

U.S. PATENT DOCUMENTS

| | | | | |
|---|---|---|---|---|
| 7,641,483 | B2 * | 1/2010 | Wei et al. | 439/131 |
| 7,959,448 | B1 * | 6/2011 | Chou et al. | 439/131 |
| 7,980,868 | B2 * | 7/2011 | Chou et al. | 439/131 |
| 2009/0197442 | A1 * | 8/2009 | Wei et al. | 439/131 |
| 2009/0197474 | A1 * | 8/2009 | Wei et al. | 439/669 |
| 2011/0130017 | A1 * | 6/2011 | Chou et al. | 439/131 |
| 2011/0136356 | A1 * | 6/2011 | Chou et al. | 439/131 |

FOREIGN PATENT DOCUMENTS

| | | |
|---|---|---|
| TW | M372558 | 1/2010 |
| TW | M416238 | 11/2011 |
| TW | M418470 | 12/2011 |

* cited by examiner

*Primary Examiner* — Phuongchi T Nguyen

(74) *Attorney, Agent, or Firm* — Stephen L. Sheldon

(57) ABSTRACT

A receptacle connector comprises an insulative housing, a plurality of conductive terminals arranged in the insulative housing, a metal shell and a slide mechanism. The metal shell is engaged with the insulative housing to form a first mating space and an entrance for entering into the first mating space. The slide mechanism is provided in the metal shell and comprises a slide block and a reset resilient element connected to the slide block. The slide block can move between a front position close to the entrance and a rear position away from the entrance. When the slide block is positioned at the front position, an inner side face of the slide block and the metal shell together form a second mating space, and the slide block is capable of being pushed to move to the rear position to move out of the first mating space.

10 Claims, 13 Drawing Sheets

RECEPTACLE CONNECTOR AND CONNECTOR ASSEMBLY

RELATED APPLICATIONS

This application claims priority to Taiwan Application No. 101119527, filed May 31, 2012, which is incorporated herein by reference in its entirety.

TECHNICAL FIELD

The technical field relates to a receptacle connector, particularly to a receptacle connector capable of being respectively mated with two plugs with different volumes.

BACKGROUND

With development of digital technology, digital video data require for a transport protocol with a high transmission frequency bandwidth to improve transmission speed and signal quality. At present, two transmission specifications which are Display Port and High Definition Multimedia Interface (hereinafter referred as HDMI) become a mainstream for digital video transmission. As Display Port and HDMI belong to different transmission specifications, respectively have their own application objects, and a design is to integrate Display Port and HDMI specifications into the same receptacle connector to form a combined type receptacle connector, to allow the combined type receptacle connector to respectively be mated with a Display Port plug and an HDMI plug, so as to save a space occupied by a receptacle connector additionally used.

However, the Display Port plug is bigger than the HDMI plug in volume, a shape of insertion port of the combined type receptacle connector corresponds to a shape of the Display Port plug, so that the insert port of the combined type receptacle connector is bigger than the HDMI plug, therefore it is difficult to align when the HDMI plug is inserted. Taiwanese patent No. TWM416238 discloses a receptacle connector, which uses lateral movement of a switch component provided at one side of a shielding shell to selectively mate a HDMI plug and a Display Port plug. As the switch component is provided in exterior of the receptacle connector, it is required to additionally occupy an exterior space of the receptacle connector. In addition, the switch component requires a user to manually control to move, the user unfamiliar with an electrical appliance may be incapable of using the switch component, which does not meet requirements for intuitive use.

SUMMARY

Therefore, a connector assembly of an embodiment comprises a first plug connector, a second plug connector and a receptacle connector. The first plug connector comprises a first plug. The second plug connector comprises a second plug smaller than the first plug in volume. The receptacle connector comprises an insulative housing, a plurality of conductive terminals arranged in the insulative housing, a metal shell and a slide mechanism. The metal shell is engaged with the insulative housing to form a first mating space and an entrance for entering into the first mating space. The slide mechanism is provided in the metal shell and comprises a slide block and a reset resilient element connected to the slide block. The slide block is capable of moving between a front position close to the entrance and a rear position far away from the entrance, and the slide block is positioned at the front position in a normal state due to action of the reset resilient element. When the slide block is positioned at the front position namely at one side in the first mating space, an inner side face of the slide block and the metal shell together form a second mating space, and the slide block is capable of being pushed to move to the rear position to move out of the first mating space.

Furthermore, the receptacle connector further comprises a first detecting switch. The first detecting switch comprises a first terminal provided to the slide block, and the first terminal has a resilient contact portion protruding from the slide block and extending into the second mating space. When the second plug is inserted into the second mating space, the metal shell abuts against the resilient contact portion. The first detecting switch further comprises a second terminal provided to the insulative housing, the first terminal further has a first conduct portion, the second terminal has a second conduct portion opposite to the first conduct portion and a tail portion extending out from the insulative housing. The reset resilient element can conduct electricity and is connected to the first conduct portion and the second conduct portion respectively at two ends thereof so as to electrically connect the first terminal and the second terminal.

Furthermore, the receptacle connector further comprises a second detecting switch provided to the insulative housing and corresponding to the slide block, when the slide block is pushed by the first plug to move to the rear position, the second detecting switch is turned on. The second detecting switch comprises a third terminal and a fourth terminal, when the slide block moves to the rear position, the slide block pushes the third terminal to change a contact state between the third terminal and the fourth terminal to turn on the second detecting switch.

In addition, the metal shell has a polarizing resilient tab, and a part of the polarizing resilient tab extends into the first mating space to prevent incorrect insertion of the second plug. Furthermore, the polarizing resilient tab has a guide portion and a stopping portion which extend into the first mating space. The guide portion is close to the entrance relative to the stopping portion, when the guide portion is pressed, the guide portion links the stopping portion to move out of the first mating space.

DESCRIPTION OF THE EMBODIMENTS

Figure 1:
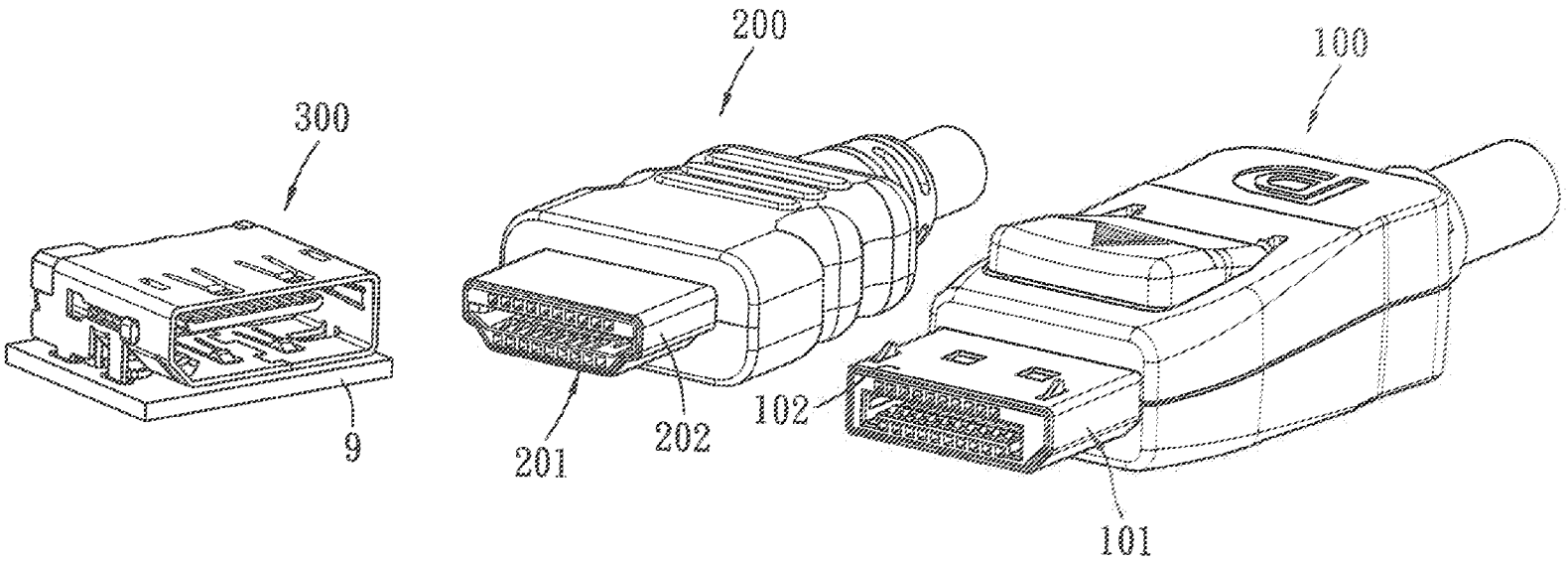
FIG. 1 is a perspective view illustrating a connector assembly in an embodiment.

The foregoing and other technical contents, features and effects of the embodiments will be apparent through the following detailed description for an embodiment in combination with the drawings. Before the embodiment is described in details, it should be noted that like elements are indicated by same reference numerals in the following description.

The depicted connector design has several benefits. One is that the slide block can move from the front position to the rear position along the mating direction, and automatically return to the front position with the reset resilient element, thus it helps provide good guiding and alignment during insertion of the first plug or the second plug selected by the user and the first plug or the second plug can be easily mated with the corresponding conductive terminals when the first plug or the second plug is inserted. In addition, the slide block can be positioned in the first mating space so that it does not occupy the exterior space of the receptacle connector. Furthermore, the slide mechanism is engaged with the detecting switches to detect insertion of the first plug and the second plug. In addition, the receptacle connector further has polarizing mechanisms to prevent incorrect insertion of the second plug.

Thus, the depicted embodiments provide a receptacle connector capable of automatically switching two mating spaces with different sizes to respectively mate two plug connectors with different sizes. Certain embodiment can provide a receptacle connector having detecting switches. In addition, an embodiment can provide a connector assembly comprising two plug connectors with different sizes and a receptacle connector capable of being respectively mated with the plug connectors.

Figure 2:
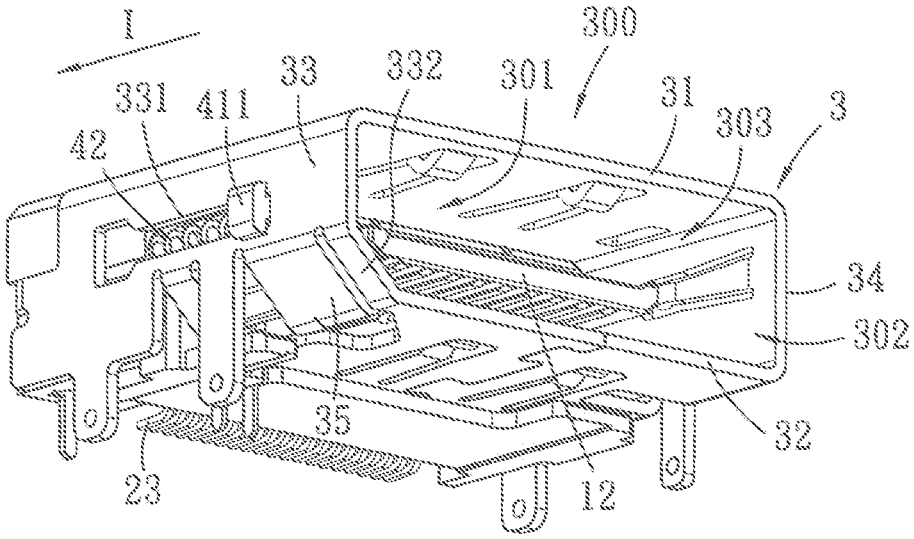
FIG. 2 is a perspective view illustrating a receptacle connector in the embodiment.

Referring to FIG. 1 and FIG. 2, a connector assembly of an embodiment comprises a first plug connector 100, a second plug connector 200 and a receptacle connector 300. The first plug connector 100 comprises a first plug 101, and the first plug 101 has a metal shell 102. The second plug connector 200 comprises a second plug 201 smaller than the first plug 101 in volume, and the second plug 201 has a metal shell 202. The receptacle connector 300 is mounted on a circuit board 9, for being respectively mated with the first plug 101 and the second plug 201. In the embodiment, the first plug connector 100 is a Display Port plug connector, and the second plug connector 200 is a HDMI plug connector.

Figure 3:
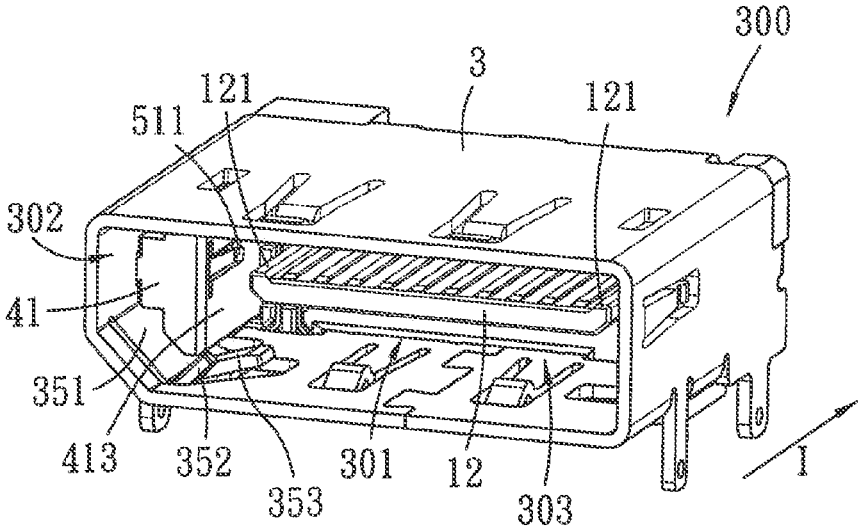
FIG. 3 is a view of FIG. 2 from another angle.
Figure 4:
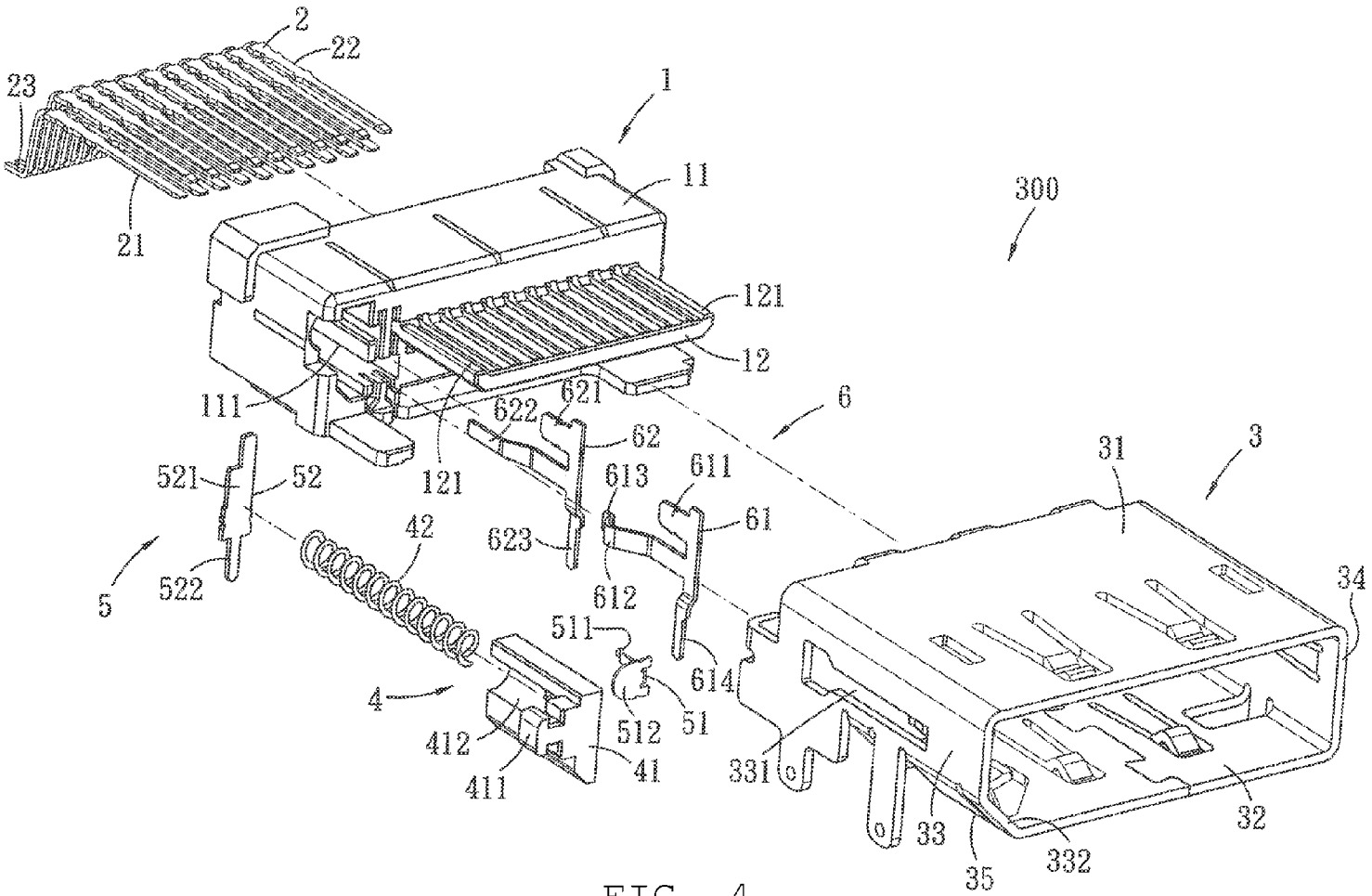
FIG. 4 is an exploded view of FIG. 2.
Figure 5:
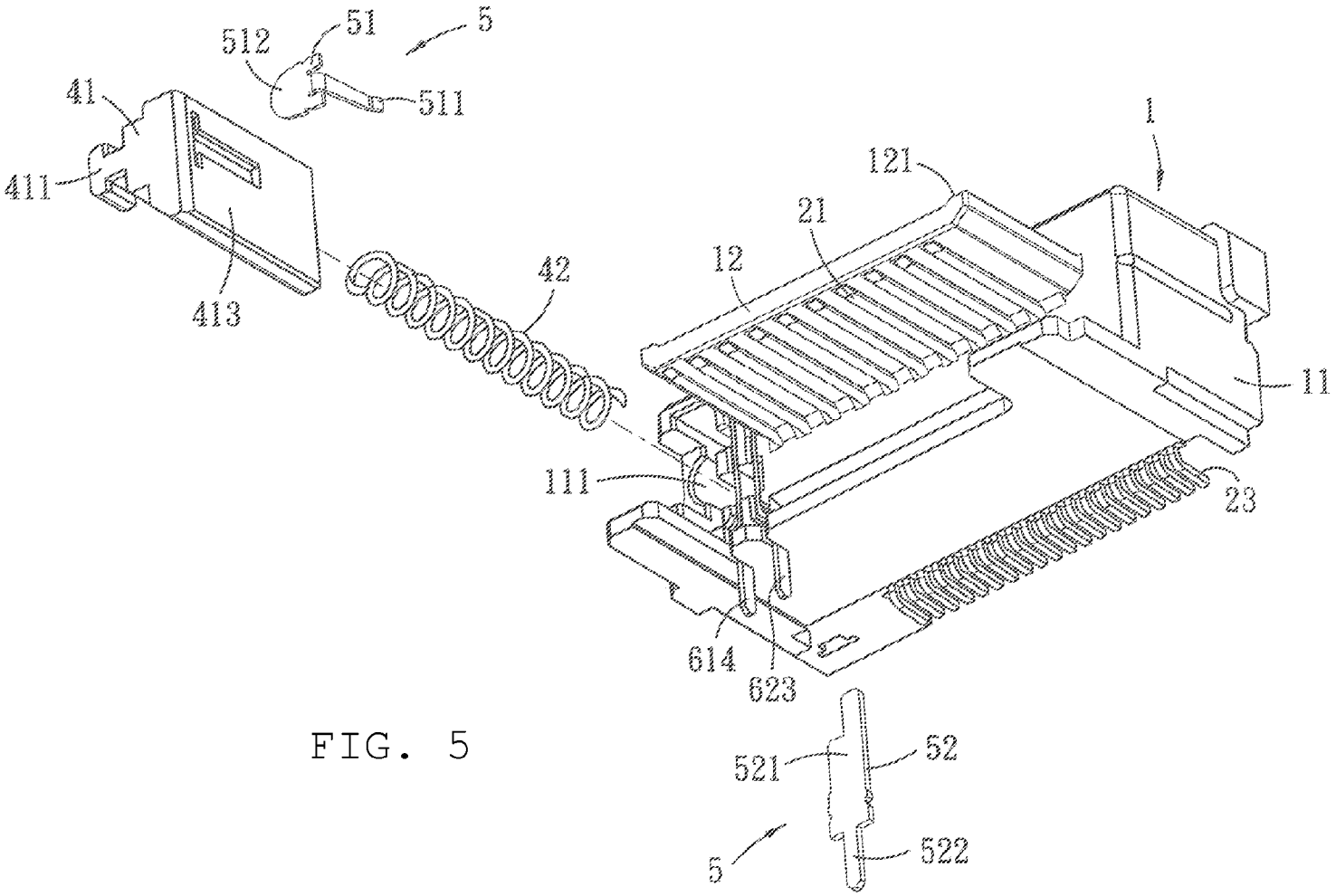
FIG. 5 a partial exploded view illustrating a slide mechanism and a first detecting switch in the embodiment.
Figure 6:
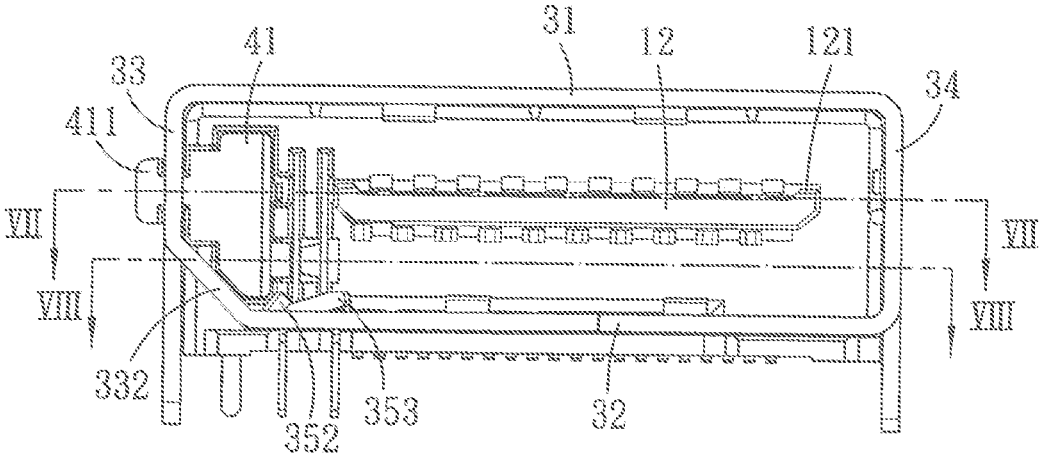
FIG. 6 is a front view of FIG. 2.
Figure 7:
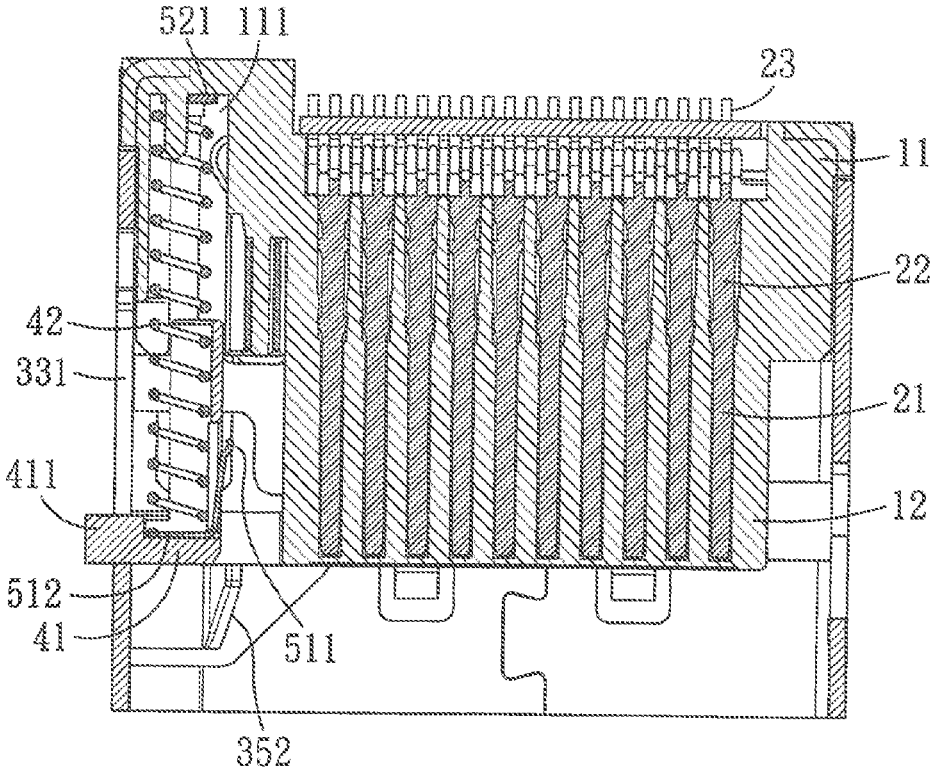
FIG. 7 is a cross-sectional view taken along a line VII-VII of FIG. 6 illustrating that a slide block in the embodiment is at the front position.

Referring to FIGS. 3-5, the receptacle connector 300 comprises an insulative housing 1, a plurality of conductive terminals 2, a metal shell 3, a slide mechanism 4, a first detecting switch 5 and a second detecting switch 6.

The insulative housing 1 has a base 11 and a tongue plate 12 extending from the base 11. The base 11 has a receiving space 111. The tongue plate 12 has two polarizing protrusions 121 respectively at two sides, the polarizing protrusions 121 protrude toward the same direction. The conductive terminals 2 are arranged in the insulative housing 1 as two rows, and the each conductive terminal 2 has a contact portion 21 exposed from the tongue plate 12, a fixed portion 22 fixed in the insulative housing 1, and a tail portion 23 extending out behind the insulative housing 1 to be electrically connected with the circuit board 9. The metal shell 3 is engaged with the insulative housing 1 to form a first mating space 301 for receiving the first plug 101 and an entrance 302 for entering into the first mating space 301. Specifically, the metal shell 3 has a top plate 31, a bottom plate 32 opposite to the top plate 31, a first side plate 33, a second side plate 34 and a polarizing resilient tab 35. The first side plate 33 and the second side plate 34 are respectively connected to two sides of the top plate 31 and the bottom plate 32, and the first side plate 33 has a guide rail 331 and an oblique portion 332 which extend along a mating direction I. The first mating space 301 is defined by parts of the top plate 31, the bottom plate 32, the first side plate 33 and the second side plate 34 which together surround the tongue plate 12. The polarizing resilient tab 35 has a main body 351, and a guide portion 352 and a stopping portion 353 which are connected to the main body 351 and extend into the first mating space 301. The main body 351 is formed at the oblique portion 332 of the first side plate 33, the guide portion 352 and the stopping portion 353 are respectively formed at partial bottom plate 32 connected to the oblique portion 332, and the guide portion 352 is close to the entrance 302 relative to the stopping portion 353.

The slide mechanism 4 is provided in the metal shell 3, and comprises a slide block 41 and a reset resilient element 42 connected to the slide block 41. The slide block 41 has a limiting portion 411 matched with the guide rail 331 of the metal shell 3 and a receiving groove 412 for receiving the reset resilient element 42. As depicted, the limiting portion 411 is a transversal T-shape, sheaths on and is limited on the guide rail 331 and can slide along the guide rail 331, to allow the slide block 41 to move between a front position close to the entrance 302 (in combination with referring to FIG. 8) and a rear position far away from the entrance 302 (in combination with referring to FIG. 11) along the mating direction I, and the slide block 41 is positioned at the front position in a normal state due to action of the reset resilient element 42. When the slide block 41 is positioned at the front position namely at one side in the first mating space 301, an inner side face 413 of the slide block 41 and the metal shell 3 together form a second mating space 303 for receiving the second plug 201, and the slide block 41 can be pushed by the first plug 101 to move to the rear position to move out of the first mating space 301. In other words, the second mating space 303 is namely a part of the first mating space 301, when the slide block 41 is positioned at the front position, the slide block 41 occupies a partial space of the first mating space 301, a remaining space of the first mating space 301 forms the second mating space 303, so that the second mating space 303 is smaller than the first mating space 301 and thus can be matched with the second plug 201 with a smaller volume.

Figure 8:
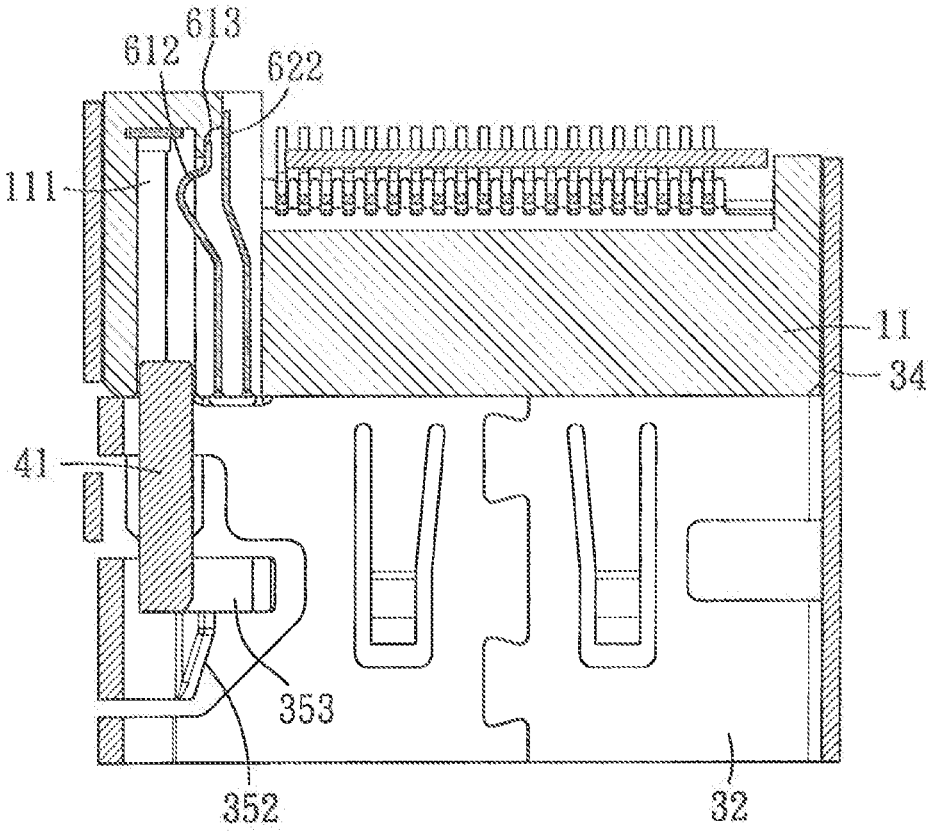
FIG. 8 is a cross-sectional view taken along a line VIII-VIII of FIG. 6 illustrating an relative relationship between a second detecting switch and the slide block in the embodiment when the slide block is at the front position.
Figure 9:
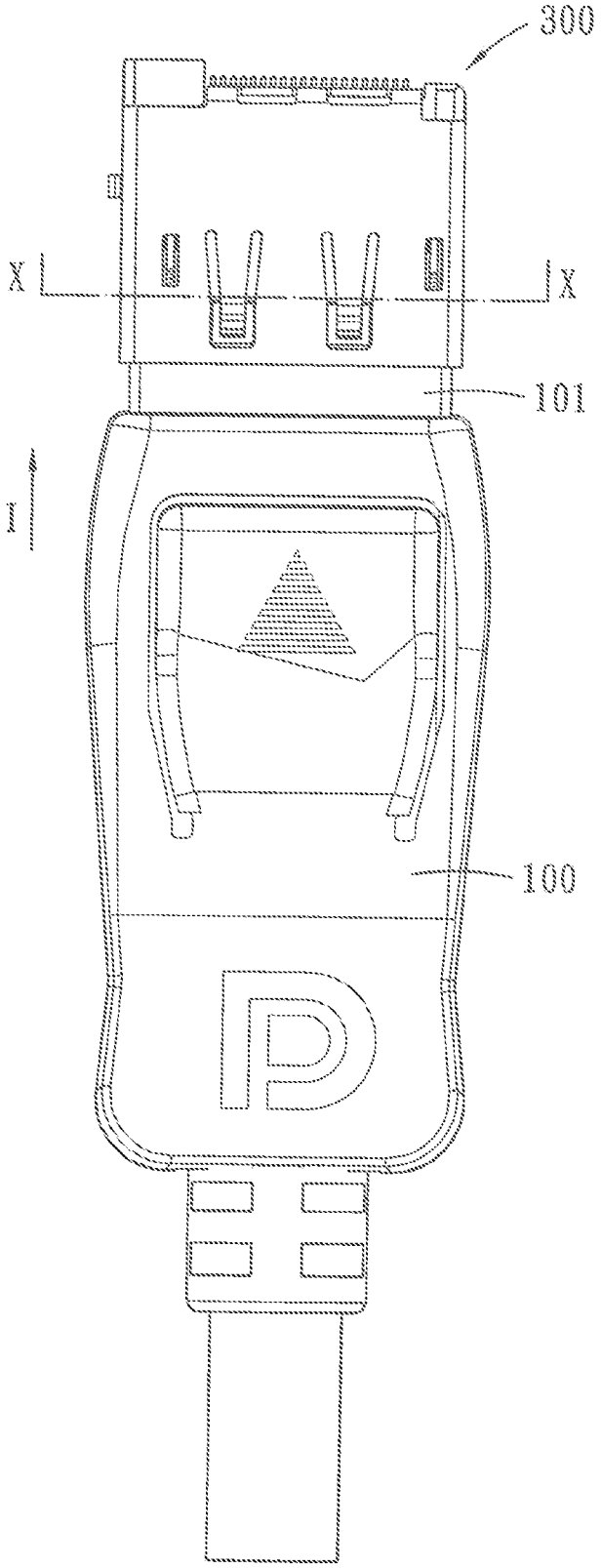
FIG. 9 is a top view illustrating a first plug connector is mated with the receptacle connector in the embodiment.

Referring to FIGS. 4-8, the first detecting switch 5 comprises a first terminal 51 provided to the slide block 41 and a second terminal 52 provided to the insulative housing 1. The first terminal 51 has a resilient contact portion 511 protruding from the inner side face 413 of the slide block 41 and extending into the second mating space 303 (referring to FIG. 3) and a first conduct portion 512 exposed toward the receiving groove 412. The second terminal 52 has a second conduct portion 521 opposite to the first conduct portion 512 and a tail portion 522 extending out of the insulative housing 1 to be electrically connected with the circuit board 9. The second conduct portion 521 is positioned at a rear end of the receiving space 111, and the first conduct portion 512 and the second conduct portion 521 are both plat-plate shapes, and are provided as a plate-surface to plate-surface manner. In the embodiment, the reset resilient element 42 is a coil spring made from a conductive metal, itself can conduct electricity and is connected to the first conduct portion 512 and the second conduct portion 521 respectively at two ends thereof to electrically connect the first terminal 51 and the second terminal 52. The two ends of the reset resilient element 42 are respectively connected with the first conduct portion 512 and the second conduct portion 521 in an abutting way. The first terminal 51 is electrically connected with the circuit board 9 via the reset resilient element 42 and the second terminal 52. The second detecting switch 6 comprises a third terminal 61 and a fourth terminal 62, is provided to the insulative housing and corresponds to the slide block 41. The third terminal 61 has a fixed portion 611 fixed to the insulative housing 1, a pushed portion 612 extending into the receiving space 111, a third contact portion 613 connected to a distal end of the pushed portion 612, and a tail portion 614 extending out of the insulative housing 1 to be electrically connected with the circuit board 9. The fourth terminal 62 has a fixed portion 621 fixed to the insulative housing 1, a fourth contact portion 622 for being contacted by the third contact portion 613, and a tail portion 623 extending out of the insulative housing 1 to be electrically connected with the circuit board 9. In the present embodiment, when the third terminal 61 and the fourth terminal 62 are in a normal state, as shown in FIG. 8, the third contact portion 613 and the fourth contact portion 622 are spaced apart and do not contact.

Figure 10:
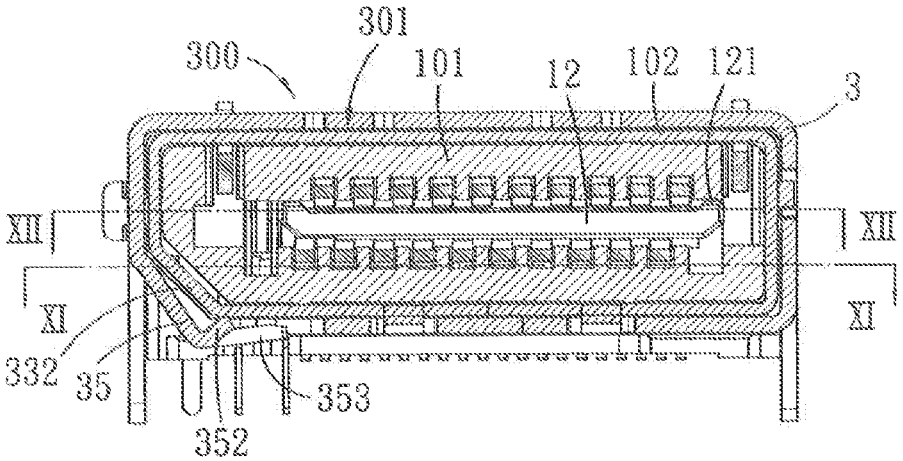
FIG. 10 is a cross-sectional view taken along a line X-X of FIG. 9 illustrating an action relation between a first plug and a polarizing resilient tab in the embodiment.
Figure 11:
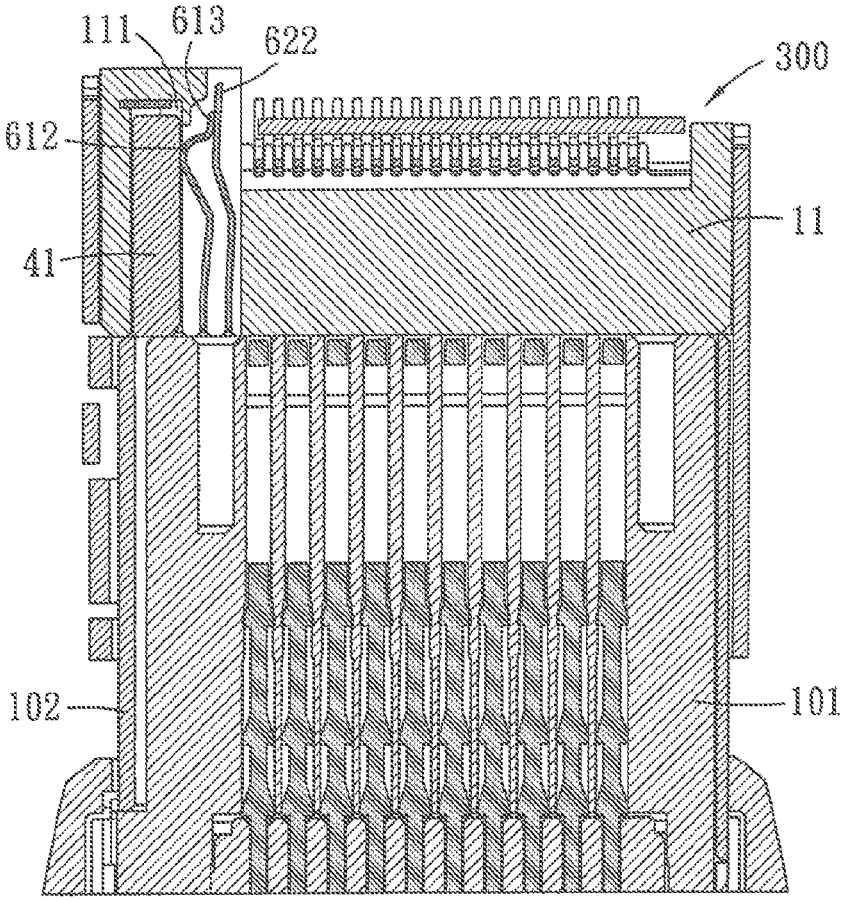
FIG. 11 is a cross-sectional view taken along a line XI-XI of FIG. 10 illustrating that the slide block is pushed by the first plug to move to a rear position and turn on the second detecting switch in the embodiment.
Figure 12:
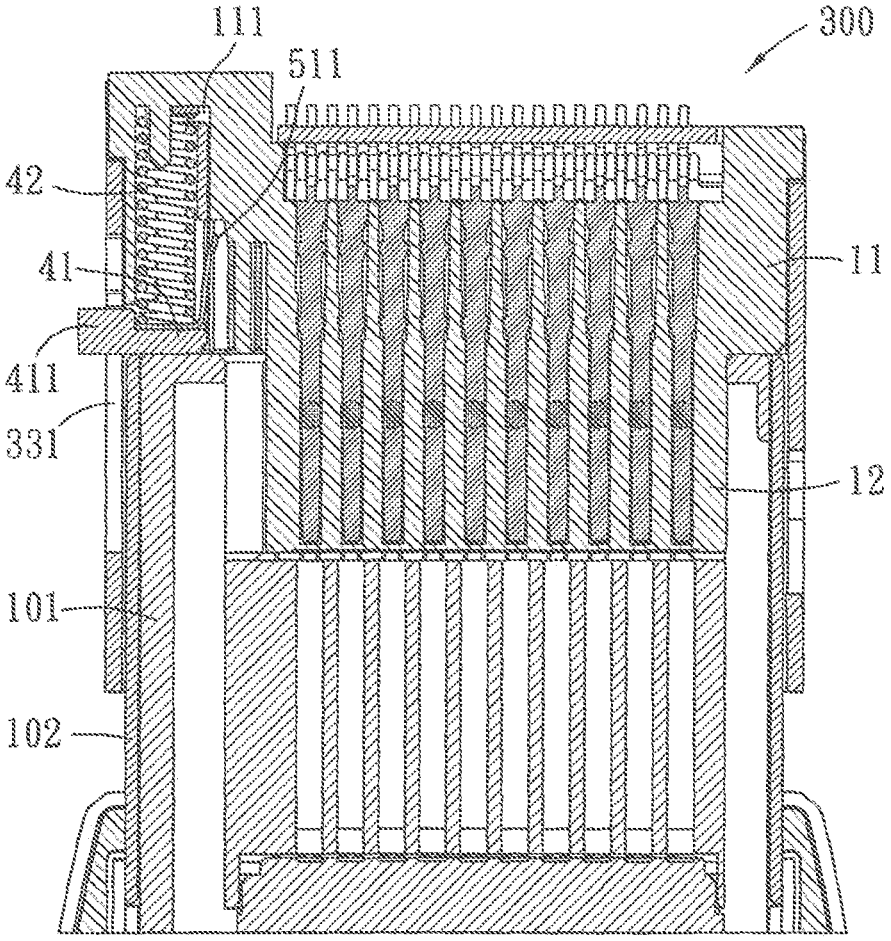
FIG. 12 is a cross-sectional view taken along a line XII-XII of FIG. 10 illustrating that the slide block moves to the rear position and simultaneously compress a reset resilient element in the embodiment.

Referring to FIGS. 9-12, when the first plug 101 of the first plug connector 100 is inserted into the receptacle connector 300 along the mating direction I, the first plug 101 may fully occupy the first mating space 301 (referring to FIG. 3). And by corresponding between the oblique portion 332 (referring to FIG. 6) of the first side plate 33 and an undercutting corner (not indicated for referential numeral) at a side edge of the first plug 101, the incorrect insertion of the first plug 101 can be prevented. As shown in FIG. 3 and FIG. 10, when the first plug 101 is inserted into the first mating space 301, the first plug 101 firstly touches the guide portion 352 of the polarizing resilient tab 35 to press the guide portion 352 downwardly, the guide portion 352 simultaneously drives the stopping portion 353 to move downwardly, so as to together move out of the first mating space 301, so that the first plug 101 can continue to move toward inside of the first mating space 301. As shown in FIGS. 11-12, when the first plug 101 moves to the base 11 from the entrance 302 (referring to FIG. 3), the first plug 101 would push the slide block 41 and cause the slide block 41 to move to the rear position (as shown in FIG. 11 and FIG. 12) from the front position (referring to FIG. 7), simultaneously the reset resilient element 42 is compressed to accumulate a restoring force. When the slide block 41 moves, the slide block 41 can linearly move along the mating direction I by that the limiting portion 411 matches with the guide rail 331.

As shown in FIG. 11, when the first plug 101 abuts against the base 11 to reach a position where the first plug 101 is electrically connected with the receptacle connector 300, the slide block 41 namely reaches the rear position to enter into the receiving space 111 (referring to FIG. 8), and the slide block 41 pushes the pushed portion 612 of the third terminal 61. The pushed third terminal 61 allows the pushed portion 612 to drive the third contact portion 613 so that it can in turn contact the fourth contact portion 622 of the fourth terminal 62 and this contact can turn on the second detecting switch. As is known, the detecting switch can provide a signal that the first plug 101 has been inserted is generated. In the embodiment, the third terminal 61 and the fourth terminal 62 do not contact each other in the normal state; and when the first plug 101 is inserted, the slide block 41 pushes the third terminal 61 to allow the third terminal 61 to contact the fourth terminal 62, by which the contact state is changed to turn on the second detecting switch. However, in other embodiments as equivalent variations, it may be also designed that the third terminal 61 and the fourth terminal 62 contact each other in the normal state, and the slide block 41 pushes the third terminal 61 to allow the third terminal 61 not to contact the fourth terminal 62, by which the contact state is changed to turn on the second detecting switch.

When the first plug 101 is withdrawn from the first mating space 301, the slide block 41 can return to the front position (referring to FIG. 1 and FIG. 8) by action of the restoring force of the reset resilient element 42.

Figure 13:
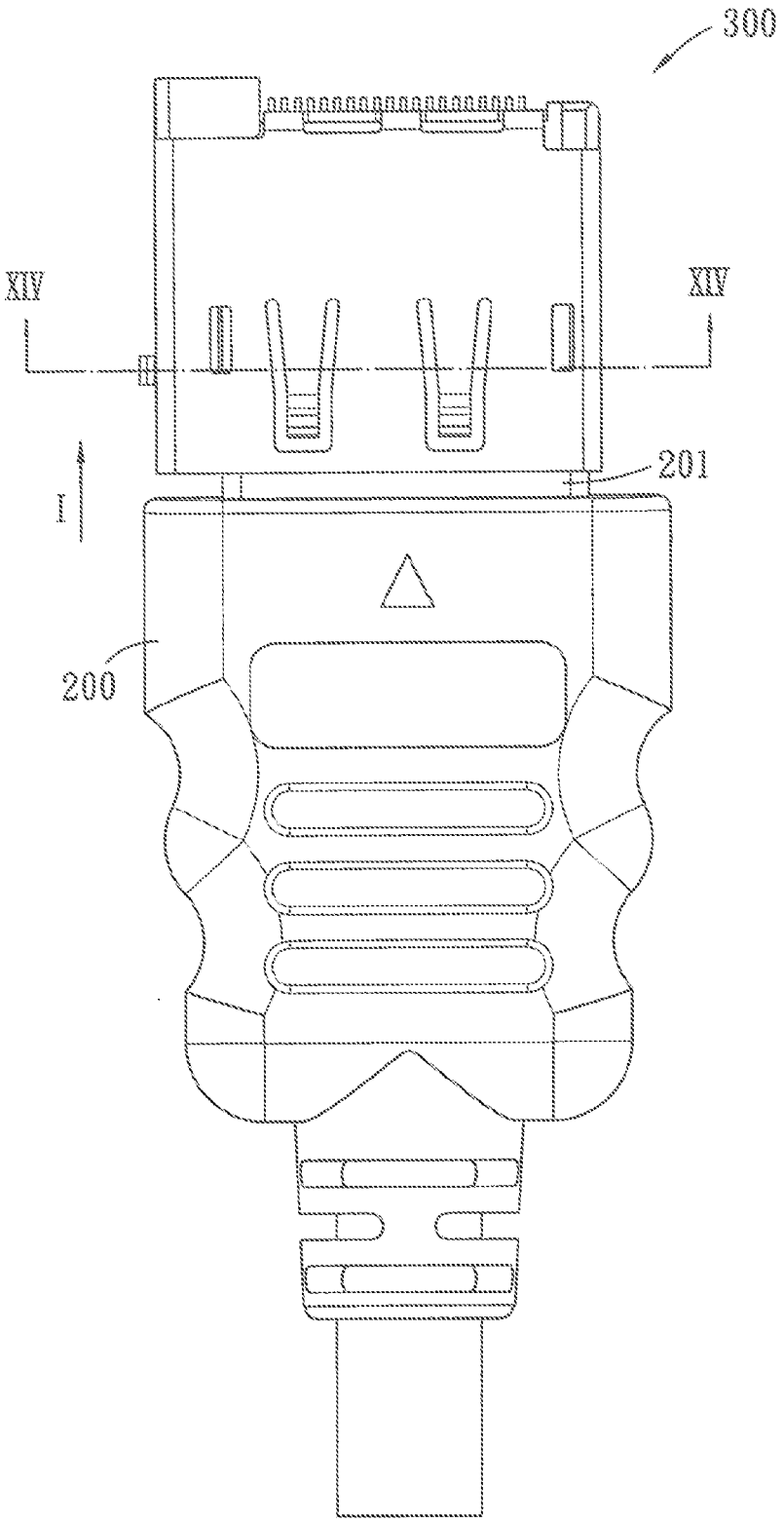
FIG. 13 is a top view illustrating that a second plug connector is mated with the receptacle connector in the embodiment.
Figure 14:
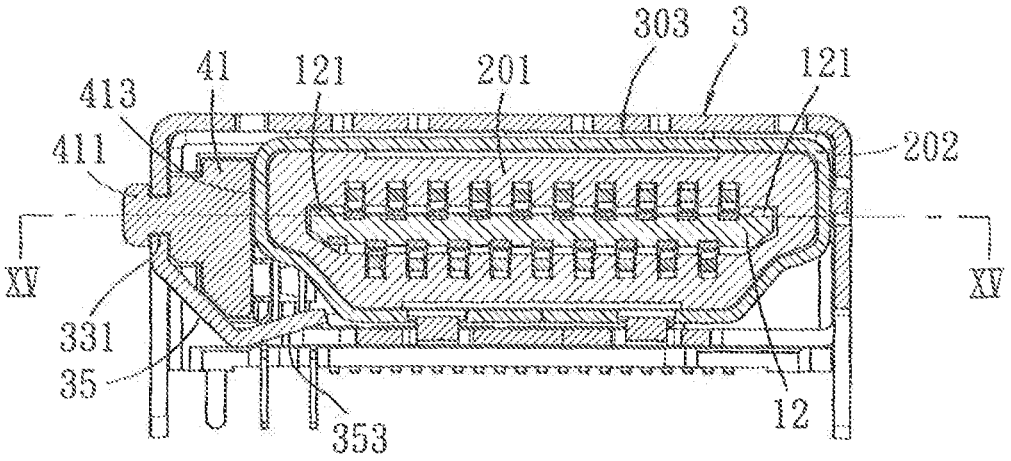
FIG. 14 is a cross-sectional view taken along a line XIV-XIV of FIG. 13 illustrating an action relationship among the second plug and the slide block and the polarizing resilient tab in the embodiment.
Figure 15:
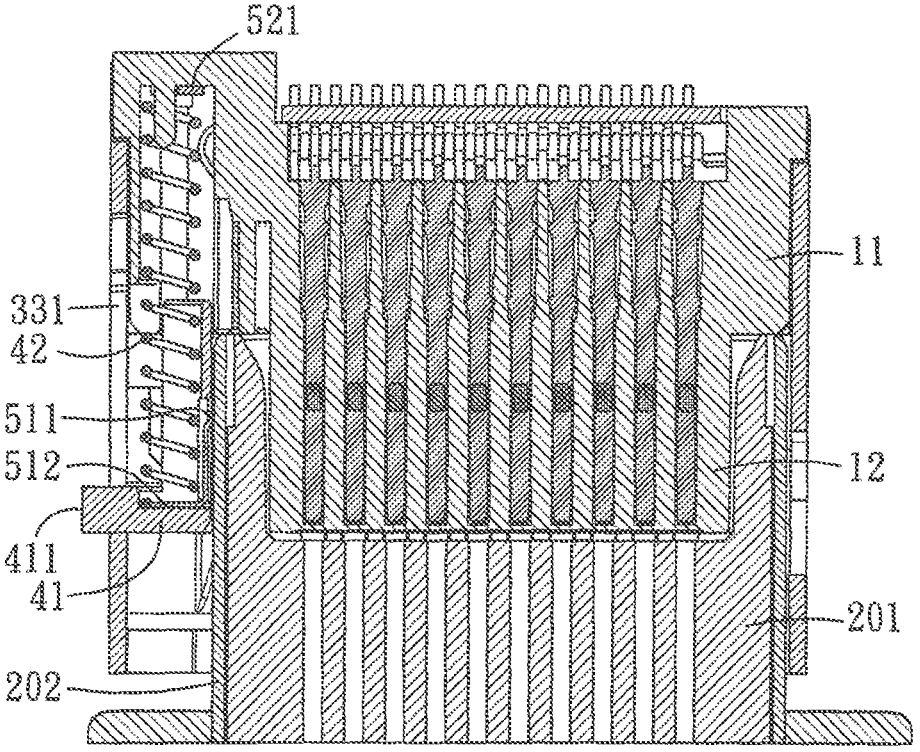
FIG. 15 is a cross-sectional view taken along a line XV-XV of FIG. 14 illustrating an action relationship between the second plug and the first detecting switch in the embodiment.

Referring to FIGS. 13-15, when the second plug 201 of the second plug connector 200 is inserted into the receptacle connector 300 along the mating direction I, as the second plug 201 is smaller than the first plug 101 in volume, the second plug 201 can be received in the second mating space 303 (referring to FIG. 3) defined by the inner side face 413 of the slide block 41 and the metal shell 3 together. By that the inner side face 413 of the slide block 41 abuts against one side of the second plug 201 to guide and align insertion of the second plug 201, the second plug 201 can be easily aligned with and mated with the tongue plate 12, namely can electrically connected with the corresponding conductive terminals 2. As shown in FIG. 15, when the second plug 201 is inserted into the second mating space 303, the metal shell 202 of the second plug 201 immediately contacts the resilient contact portion 511 of the first terminal 51 to turn on the first detecting switch, by which a signal that the second plug 201 has been inserted is generated.

Figure 16:
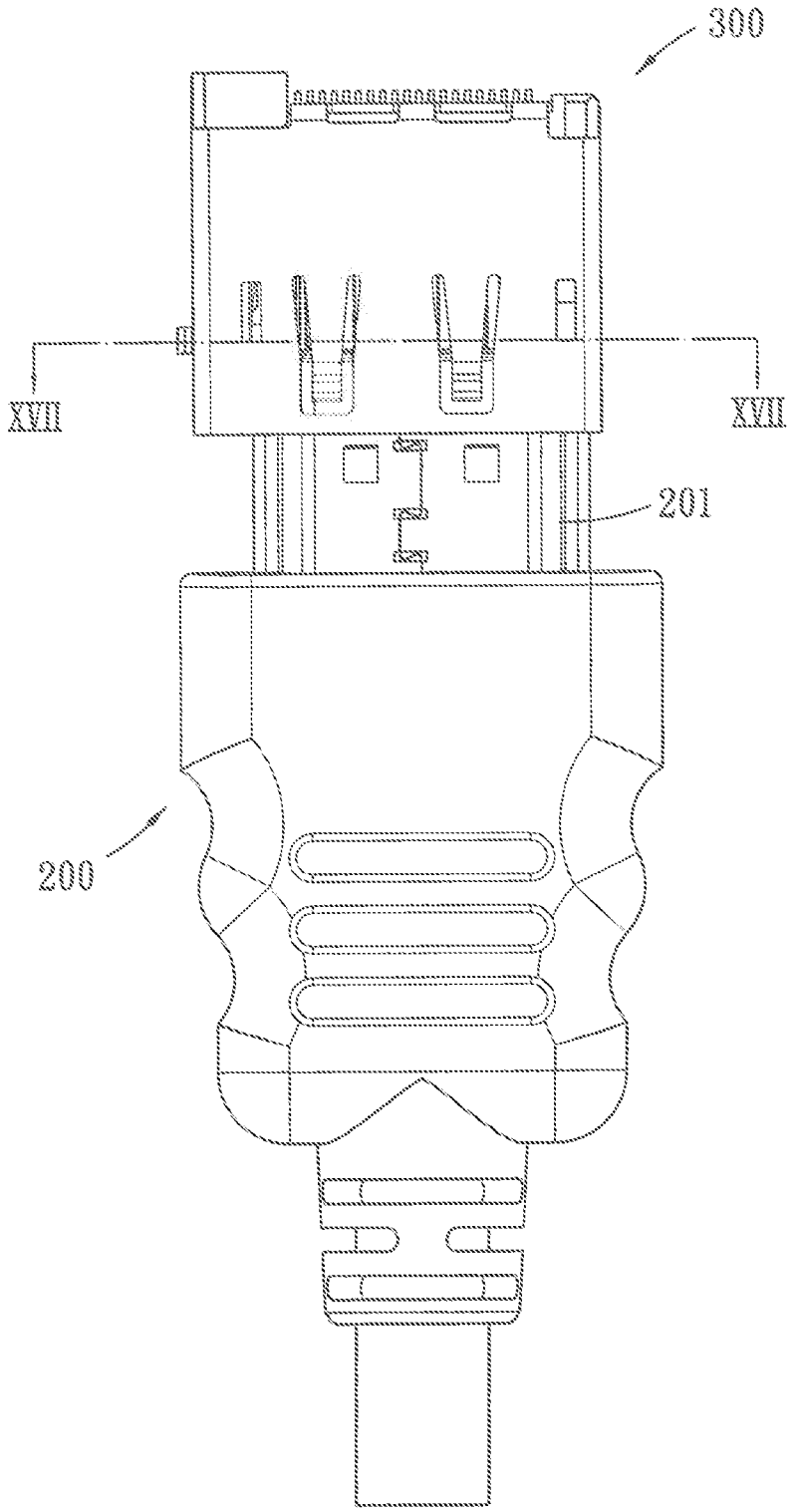
FIG. 16 is a top view illustrating that the second plug connector is incorrectly inserted into the receptacle connector in the embodiment.
Figure 17:
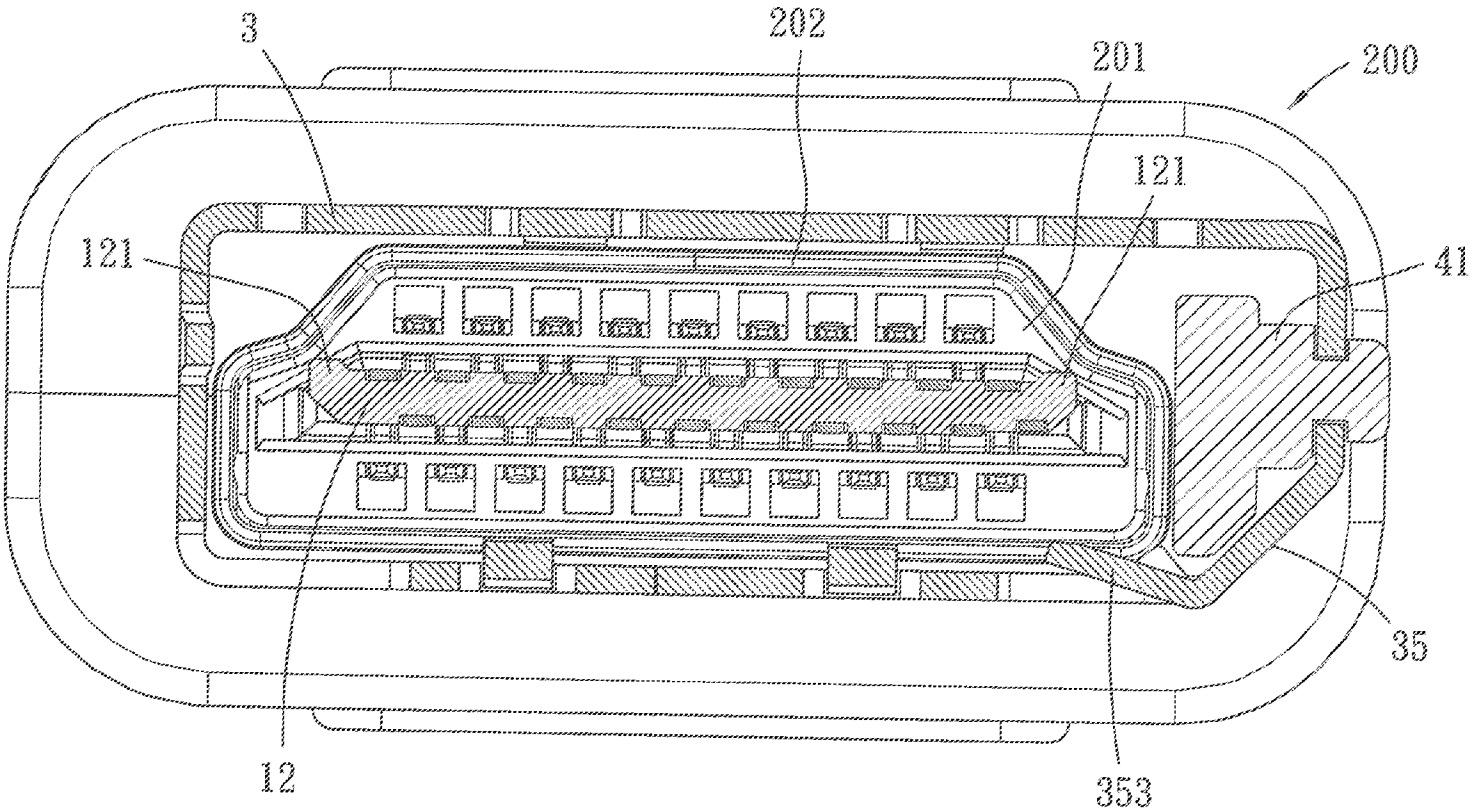
FIG. 17 is a cross-sectional view taken along a line XVII-XVII of FIG. 16 illustrating that the polarizing protrusions and the polarizing resilient tab block incorrect insertion of the second plug in the embodiment.

Referring to FIG. 16 and FIG. 17, the receptacle connector 300 has two polarizing mechanisms to prevent incorrect insertion of the second plug 201. The first mechanism utilizes the polarizing protrusions 121 protruding from the two sides of the tongue plate 12, as when the second plug 201 is incorrectly inserted, a shape of an insertion port of the second plug 201 is not matched with positions of the polarizing protrusions 121, so that incorrect insertion of the second plug 201 can be blocked by the polarizing protrusions 121. The second mechanism utilizes the stopping portion 353 of the polarizing resilient tab 35, the stopping portion 353 protrudes in a movement path along which the second plug 201 is incorrectly inserted, so as to block incorrect insertion of the second plug 201. Consequently, when a user incorrectly operates, the user cannot insert the second plug 201 into the receptacle connector 300.

As can be appreciated, the slide block 41 can move from the front position to the rear position along the mating direction I, and automatically return to the front position with the reset resilient element 42. The depicted embodiment provides for good guiding and alignment during insertion of the first plug 101 or the second plug 201 selected by the user as the first plug 101 or the second plug 201 can be easily aligned with the tongue plate 12 when the first plug 101 or the second plug 201 is inserted. In addition, the slide block 41 is positioned in the first mating space 301 and does not occupy an exterior space of the receptacle connector 300. Furthermore, the slide mechanism 4 is engaged with the detecting switch, which can detect insertion of the first plug 101 and the second plug 201. In addition, the receptacle connector 300 further has the two polarizing mechanisms for preventing incorrect insertion of the second plug 201.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

What is claimed is:

1. A receptacle connector, comprising:

an insulative housing with a tongue plate;

a plurality of conductive terminals arranged in the insulative housing and positioned on tongue plate;

a metal shell engaged with the insulative housing to form a first mating space and an entrance for entering into the first mating space, the tongue plate positioned in the first mating space; and a slide mechanism provided in the metal shell, comprising a slide block and a reset resilient element connected to the slide block, the slide block configured to move between a front position adjacent the entrance and a rear position further away from the entrance, the slide block being biased toward the front position by the reset resilient element, wherein the slide block is positioned on one side in the first mating space such that there is a space between the tongue plate and the sliding block and wherein the slide block has an inner side face and the inner side face of the slide block and the metal shell together forming a second mating space, the second mating space being smaller than the first mating space and the slide block configured to translate toward the rear position so as to move out of the first mating space when a force is applied to the sliding block.

2. The receptacle connector according to claim 1, wherein the slide block has a limiting portion, and the metal shell has a guide rail matched with the limiting portion and extending along a mating direction, the limiting portion is limited on the guide rail and can slide along the guide rail so as to allow the slide block to move between the front position and the rear position along the mating direction.

3. The receptacle connector according to claim 2, wherein the base has a receiving space for receiving the slide block, the slide block is received in the receiving space when the slide block is positioned at the rear position.

4. The receptacle connector according to claim 1, wherein the metal shell has a polarizing resilient tab, and a part of the polarizing resilient tab extends into the first mating space.

5. The receptacle connector according to claim 4, wherein the polarizing resilient tab has a guide portion and a stopping portion which extend into the first mating space, the guide portion is close to the entrance relative to the stopping portion, when the guide portion is pressed, the guide portion links the stopping portion to move out of the first mating space.

6. The receptacle connector according to claim 5, wherein the insulative housing has a base and a tongue plate extending from the base, the tongue plate is positioned in the second mating space and has two polarizing protrusions respectively positioned at two sides thereof, the conductive terminals each have a contact portion exposed from the tongue plate.

7. The receptacle connector according to claim 1, further comprising a first detecting switch, the first detecting switch comprising a first terminal provided to the slide block, and the first terminal having a resilient contact portion protruding from the slide block and extending into the second mating space.

8. The receptacle connector according to claim 7, wherein the first detecting switch further comprises a second terminal provided to the insulative housing, the first terminal including a first conduct portion, wherein the second terminal has a second conduct portion opposite the first conduct portion and a tail portion extending out from the insulative housing, the reset resilient element being conductive and connected to the first conduct portion and the second conduct portion respectively at two ends thereof so as to electrically connect the first terminal and the second terminal.

9. The receptacle connector according to claim 8, further comprising a second detecting switch provided to the insulative housing and corresponding to the slide block, the second detecting switch configured to be turned on when the slide block moves to the rear position.

10. The receptacle connector according to claim 9, wherein the second detecting switch comprises a third terminal and a fourth terminal, when the slide block moves to the rear position, the slide block pushes the third terminal to change a contact state between the third terminal and the fourth terminal.

* * * * *